United States Patent [19]

Reinert

[11] 4,248,167

[45] Feb. 3, 1981

[54] SAFETY SYSTEM TO PROTECT SEWING MACHINE NEEDLES

[75] Inventor: Gerhard Reinert, Bayside, N.Y.

[73] Assignee: The Singer Company, Stamford, Conn.

[21] Appl. No.: 51,334

[22] Filed: Jun. 22, 1979

[51] Int. Cl.[3] ..... D05B 3/02

[52] U.S. Cl. ..... 112/158 R; 112/168; 112/277

[58] Field of Search ..... 112/277, 235, 168, 158 R, 112/240, 158 E

[56] References Cited

U.S. PATENT DOCUMENTS

| | | | |
|---|---|---|---|
| 2,418,356 | 4/1947 | Kleber | 112/277 |
| 3,425,378 | 2/1969 | Kaplan | 112/235 |
| 3,926,133 | 12/1975 | Herron et al. | 112/168 |
| 3,985,087 | 10/1976 | Herr et al. | 112/237 X |

FOREIGN PATENT DOCUMENTS

| | | | |
|---|---|---|---|
| 1135277 | 10/1961 | Fed. Rep. of Germany | 112/235 |
| 1910562 | 9/1970 | Fed. Rep. of Germany | 112/235 |

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

A system is disclosed for minimizing sewing needle breakage on a zig zag sewing machine. A device is included on the sewing machine for sensing the presence of a straight stitch presser foot and, if present, for inhibiting any lateral jogging of the needle bar due to the operator inadvertently selecting a zig zag pattern.

4 Claims, 6 Drawing Figures

SAFETY SYSTEM TO PROTECT SEWING MACHINE NEEDLES

DESCRIPTION

BACKGROUND OF THE INVENTION

This invention relates to zig zag sewing machines, and in particular, to devices for controlling the lateral jogging of the sewing needle.

In designing a presser foot for a sewing machine, it is desirable to make the needle aperture therethrough as small as practicable such that the amount of unsupported material being sewn is kept to a minimum. However, while making zig zag stitches, the needle must move laterally forcing the operator to use a presser foot with a laterally elongated needle aperture. If the sewing machine is operated in the zig zag mode while a straight stitch presser foot is installed, the needle will be impeded by the presser foot causing the needle to break.

The U.S. Pat. Nos. 3,926,133 of Herron, et al and 3,985,087 of Herr, et al disclose systems for detecting the presence of a throat plate with a straight stitch aperture. Upon detecting this plate, the lateral jogging of the needle is inhibited. This invention thus seeks to apply these principles to the presser foot of a zig zag sewing machine.

SUMMARY OF THE INVENTION

Based on the above, an object of this invention is to provide a system to prevent needle breakage which detects the presence of a straight stitch presser foot.

Another object of this invention is to provide a system to prevent needle breakage which is capable of inhibiting lateral jogging of a sewing machine sewing needle.

These objects are achieved in a sewing machine having an endwise reciprocatory needle bar arranged for lateral jogging motion, a sewing needle removably attached to the needle bar, means for laterally jogging said needle bar, a downwardly biased presser bar arranged to interchangeably accept a variety of presser feet, means for detecting the presence of a straight stitch presser foot and means for selectively inhibiting the needle jogging means in response to the detecting means.

DESCRIPTION OF THE DRAWINGS

With the above and additional objects and advantages in mind as will hereinafter appear, the invention will be described with reference to the accompanying drawings in which.

DESCRIPTION OF THE PREFERRED EMBODIMENT

Figure 1:
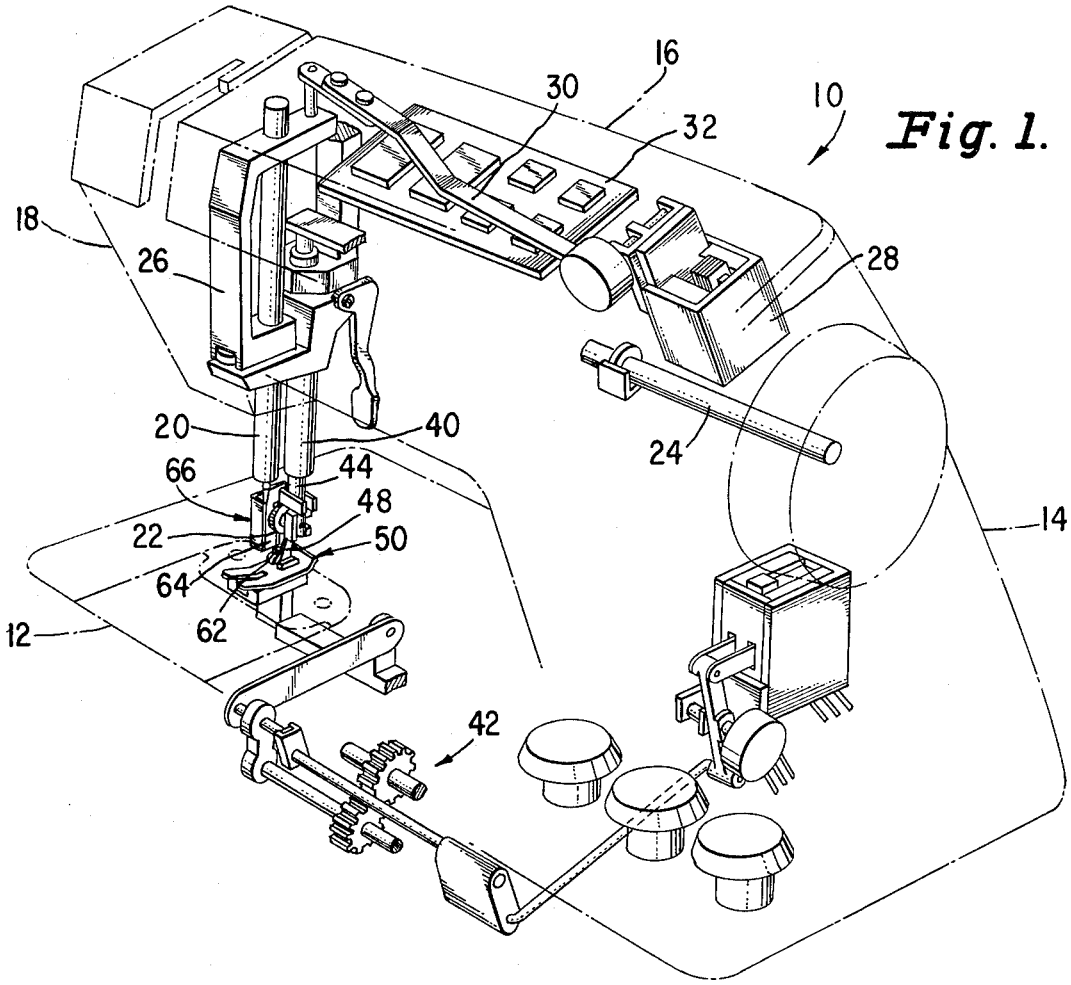
FIG. 1 is a front perspective view of a sewing machine having the invention incorporated therein.

Referring to FIG. 1, a sewing machine 10 is shown having a bed 12, a hollow standard 14 rising vertically from bed 12 and a bracket arm 16 extending horizontally from the standard 14 and overhanging the bed 12. The bracket arm 16 terminates in a sewing head 18 which carries an endwise reciprocatory needle bar 20 having a sewing needle 22 removably attached to the lower end thereof. An arm shaft 24 is shown in the bracket arm 16 and, through suitable linkage (not shown) well known in the art, imparts the reciprocatory motion to the needle bar 20. The needle bar 20 is journaled in a needle bar gate 26 which is pivotally mounted within the sewing head 18 allowing the needle bar 20 to jog laterally in the formation of zig zag stitches. A linear motor 28 is coupled with the needle bar gate 26 by an actuating link 30 and initiates the jogging motion of the needle bar gate 26 in response to electrical signals from an electronic circuit logic illustrated by a circuit board 32.

Figure 2:
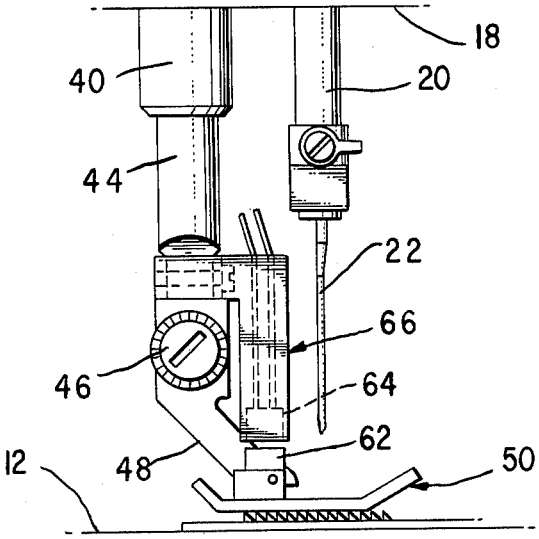
FIG. 2 is a side elevational view of the presser bar of the sewing machine.
Figure 3:
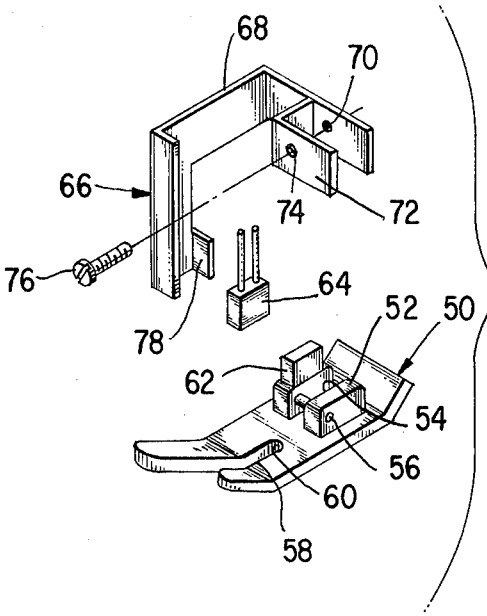
FIG. 3 is an exploded perspective view of the invention.

The sewing head 18 further carries a downwardly biased presser bar 40 for urging the material being sewn into engagement with a feed mechanism 42. Referring to FIGS. 2 and 3, the lower end 44 of the presser bar 40 is formed with a screw clamp 46 for receiving a mounting bracket 48. A straight stitch preser foot 50 is provided and includes a boss 52, having a groove 54 formed therein parallel to the central axis of the presser foot 50, and a pivot pin 56 mounted in the boss 52 and spanning the groove 54. The groove 54 allows the mounting bracket 48 to be inserted therein for attachment to the pivot pin 56. The presser foot 50 is further formed with an elongate slot 58 substantially colinear with the groove 54 and lies along the path of needle penetration in the formation of straight stitches. The slot 58 begins at the forward edge of the presser foot 50 and extends rearwardly terminating at a needle aperture 60.

In order to distinguish the straight stitch presser foot 50 from any other presser foot, a permanent magnet 62 is attached, by any suitable means, to the presser foot 50 adjacent to the boss 52. The magnet 62 interacts with a magnetic reed switch 64 which is carried by the presser bar 40. To this end, a holder 66 is formed with an arm 68 having a threaded hole 70 tapped therein and includes a removable clamp 72 having a clearance hole 74 therethrough. The arm 68 of the holder 66 along with the clamp 72 embrace the presser bar 40 lower end 44 and are held thereto by a screw 76 passing through the clearance hole 74 in the clamp 72 and engaging the threaded hole 70 in the holder 66 arm 68. The holder 66 extends downwardly from the arm 68 and is formed in a clip 78 for holding the magnetic reed switch 64.

Figure 4:
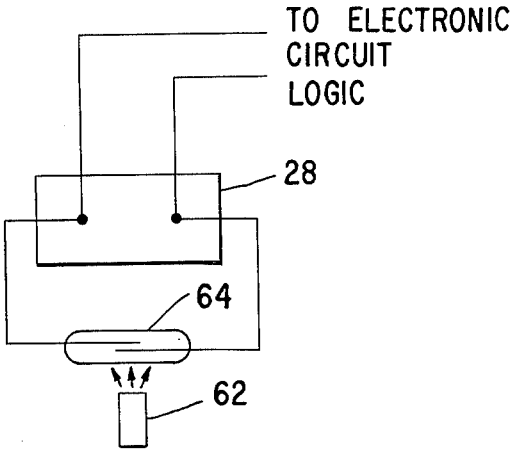
FIG. 4 is a simplified schematic diagram showing the invention coupled to a linear motor for jogging a sewing machine needle bar.

In FIG. 4, a simplified schematic diagram shows the wiring for the magnetic reed switch 64. The switch 64 is shown connected across the inputs of the linear motor 28 in parallel with the signal leads from the electronic circuit logic 32 of the sewing machine 10. By connecting the switch 64 in this manner, the closing thereof will short the electrical input of the linear motor 28 inhibiting the operation thereof.

In operation, when, for example, a zig zag presser foot not having the magnet 62 installed thereon, is attached to the presser bar 40, the magnetic reed switch 64, which is normally open, has no effect on the linear motor 28. Therefore, if the operator selects a pattern which requires zig zag stitches, the linear motor 28, responding to the circuit logic 32, causes the needle bar gate 26 to jog the needle bar 20 laterally. When the straight stitch presser foot 50 is installed on the presser bar 40, the magnet 62 attached thereto causes the magnetic reed switch 64 to close which, in turn, grounds any signals to the linear motor 28. Accordingly, if the operator selects a pattern which would require the needle bar 20 to job laterally, the linear motor 28 will not respond to signals from the circuit logic 32, thus causing the sewing machine 10 to continue sewing straight stitches.

Figure 6:
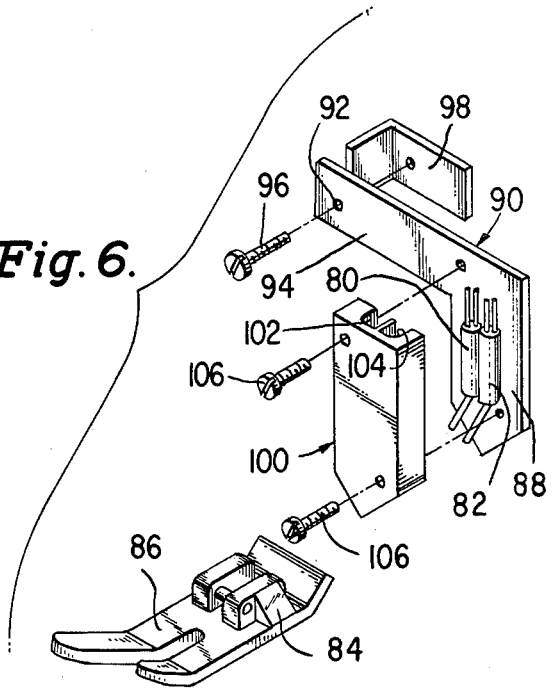
FIG. 6 is an exploded perspective view of the invention of FIG. 5.
Figure 5:
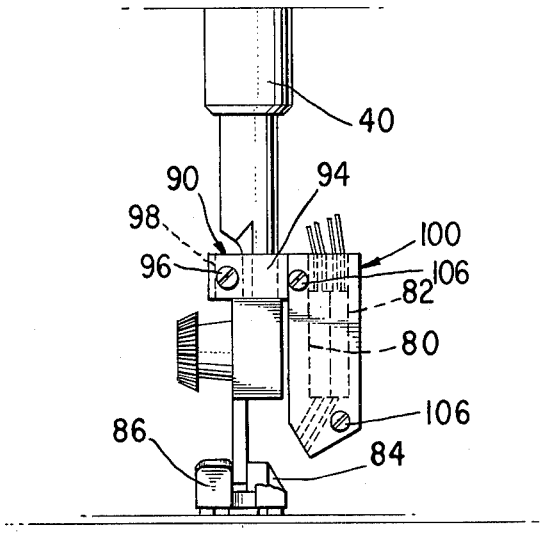
FIG. 5 is a front elevational view of the presser bar of a sewing machine showing a second embodiment of the invention incorporated therein.

FIGS. 5 and 6 illustrate a second embodiment of the invention in which a light source 80 and a light sensor 82 cooperate with a mirror 84 to detect the presence of a straight stitch pressure foot 86. As with the magnet 62 attached to the presser foot 50, the mirror 84 is mounted to the presser foot 86. A presser bar 88 is shown to which the presser foot 85 is mounted. An L-shaped bracket 90 is provided for holding the light source 80 and the light sensor 82 to the presser bar 88. To this end, a clearance hole 92 is formed in a leg 94 of the bracket 90 for receiving a screw 96 which, by threadingly engaging a clamping member 98, causes the presser bar 88 to be clamped between the bracket 90 leg 94 and the clamping member 98. A holder 100 is provided having two recesses 102 and 104 formed therein. The recesses 102 and 104 are adjacent one to the other and are shaped to receive the light source 80 and the light sensor 82, respectively. When the holder 100 is fastened to the bracket 90 using screw 106, the light source 80 and the light sensor 82 are respectively captured within the recesses 102 and 104. The bracket 90 is positioned on the presser bar 88 such that the light source 80 and the light sensor 82 will be held in close proximity to the mirror 84 when the straight stitch presser foot 86 is installed. Suitable circuitry (not shown) is provided for coupling the output from the sensor 82 to the linear motor such that when light emitted by the light source 80 is reflected from the mirror 84 and impinges the sensor 82, the sensor 82 then causes the input to the linear motor 28 to be shorted thereby inhibiting lateral jogging motion of the needle bar 20.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

I claim:

1. In a zig zag sewing machine having an endwise reciprocatory needle bar arranged for lateral jogging motion, a needle removably attached to said needle bar, means for laterally jogging said needle bar, and a downwardly biased presser bar arranged to interchangably accept a variety of presser feet inclusive of a straight stitch presser foot, means for protecting said needle comprising:

means for detecting the presence of said straight stitch presser foot; and means for inhibiting said needle bar jogging means when said detecting means senses said straight stitch presser foot.

2. The needle protecting means as set forth in claim 1 wherein said means for detecting the presence of said straight stitch presser foot comprises a permanent magnet attached to said straight stitch presser foot and a magnetic reed switch attached to said presser bar in close proximity to the end of said presser bar, said magnetic reed switch being coupled to said inhibiting means whereby when said straight stitch presser foot is attached to said presser bar, said permanent magnet, attached to said straight stitch presser foot, will close said magnetic reed switch activating said inhibiting means.

3. The needle protecting means as set forth in claim 2 wherein said needle bar jogging means is an electrical linear motor having an electrical input thereto and said inhibiting means includes said magnetic reed switch coupled to said linear motor electrical input whereby the closing of said magnetic reed switch electrically shorts said electrical input.

4. The needle protecting means as set forth in claim 1 wherein said detecting means includes a mirror mounted to said straight stitch presser foot and a light source and a light sensor mounted to said presser bar, said mirror and said light source and sensor being positioned such that when said straight stitch presser foot is attached to said presser bar, light being emitted from said light source is reflected by said mirror to said light sensor which, in turn, activates said inhibiting means.

* * * * *